US005179768A

United States Patent [19]

Jio

[11] Patent Number: 5,179,768

[45] Date of Patent: Jan. 19, 1993

[54] CLOTHESPIN

[76] Inventor: Chain-Fou Jio, No. 33, Kai-Yuan Road, Tainan City, Taiwan

[21] Appl. No.: 930,355

[22] Filed: Aug. 17, 1992

[51] Int. Cl.[5] ..... A44B 21/00

[52] U.S. Cl. ..... 24/545; 24/499; 24/543

[58] Field of Search ..... 24/545, 543, 499, 498, 24/562, 346

[56] References Cited

U.S. PATENT DOCUMENTS

| | | | |
|---|---|---|---|
| 3,604,071 | 9/1971 | Reimels | 24/543 |
| 4,079,765 | 3/1978 | Hatayan | 24/545 |
| 4,835,824 | 6/1989 | Durham et al. | 24/543 |
| 4,839,947 | 6/1989 | Cohen et al. | 24/499 |
| 5,022,126 | 6/1991 | Davis | 24/543 |

*Primary Examiner*—Victor N. Sakran

[57] ABSTRACT

A clothespin made of plastic as one unit, having two opposite pin plates, an elastic bridge formed between intermediate portions of the pin plates, an elastic plate respectively extending from a bottom end of each pin plate and bending inward, one elastic plates having a bending stopper formed at the end and two projections extending up and under near the end stopper, the elastic plate with the stopper being pressed upward to let the top of the other elastic plate push and support the former elastic plate so as to keep both of them in that position and to be compressed by the lower portions of the pin plates to open the upper portions for pinching clothes between them.

1 Claim, 3 Drawing Sheets

CLOTHESPIN

BACKGROUND OF THE INVENTION

A conventional clothespin shown in FIG. 1 comprises two pinwoods 10, 11, teeth 100, 110 on upper inner portions of the two pinwoods 10, 11, handles 101, 111 extending down from the upper portions of the pinwoods 10, 11, a rivet 12 pivotally uniting together intermediate portions of the pinwoods 10, 11 and a metal spring 120 bent to have a small circle at an intermediate portion for the rivet to pass through and two end portions 121, 121 extending along the lower inner portions of the pinwoods to give elasticity to always keep the upper portions of the pinwoods closed up for pinching clothes.

The conventional clothespin is considered to have disadvantages listed below.

1. Its assmblage is rather complicated, to a resultant high cost.

2. The spring easily loses its elasticity and gets rusted, decreasing force for pinching clothes between two teeth.

SUMMARY OF THE INVENTION

In view of the disadvantages of the above-mentioned clothepin, this invention has been devised to improve it to have a simple structure to be formed as one unit by plastic injecting process and enough elasticity to pinch clothes.

The clothespin in the present invention is made of a kind of plastic, formed as one unit by plastic injecting process. It comprises two opposite pin plates, two elastic plates extending inward from bottom ends of the two pin plates, and an elastic curved-up bridge formed between intermediate portions of the pin plates. The pin plates have teeth on upper inner portions to pinch clothes. One of the elastic plates has a slightly bending stopper at the end and two projections extending on and under near the stopper, being pressed inward or upward to let the top of the other elastic plate to push and support the upper end of the lower projection keeping both the elastic plates in that position so as to give them elasticity so that the elastic plates can be resiliently compressed inward for opening their upper portions for pinching clothes.

DETAILED DESCRIPTION OF THE INVENTION

Figure 1:
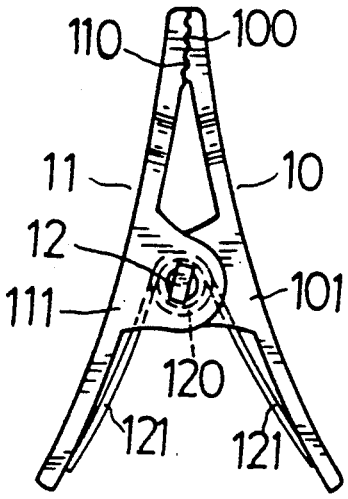
FIG. 1 (PRIOR ART)
FIG. 1 is a perspective view of a conventional clothepin.
Figure 3:
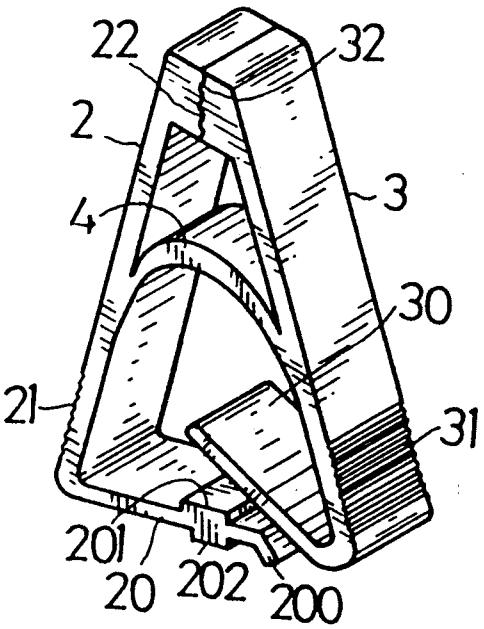
FIG. 3 is perspective view of the clothespin in the present invention.
Figure 2:
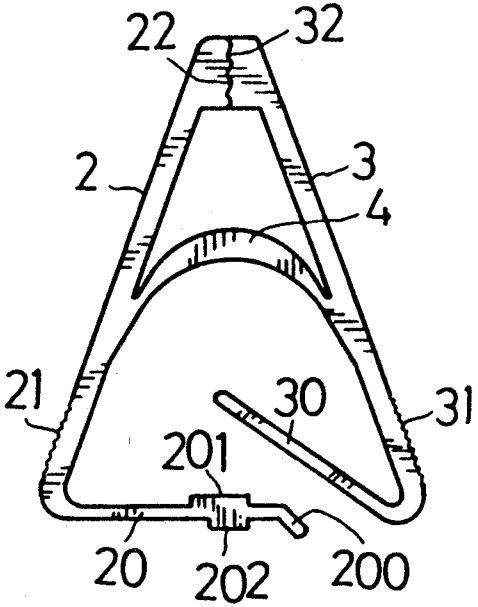
FIG. 2 is a front view of a clothespin in the present invention.
Figure 5:
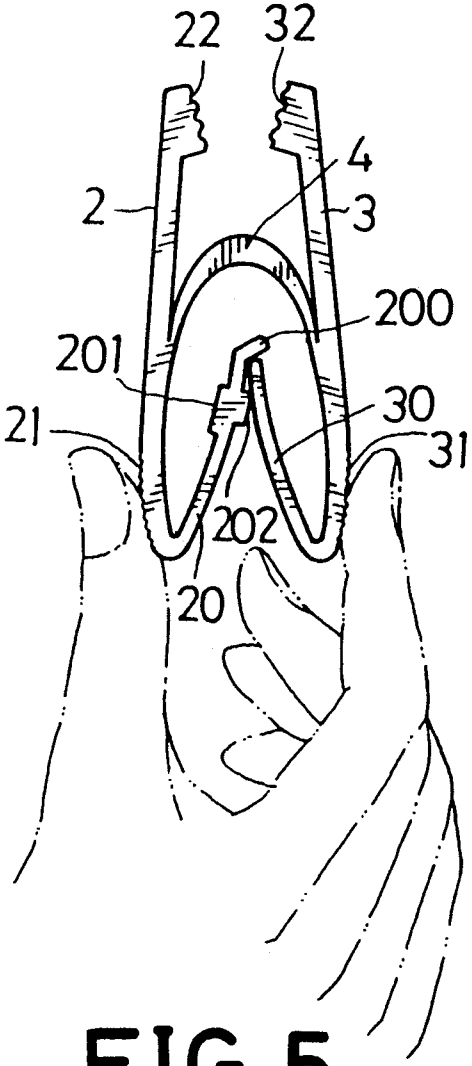
FIG. 5 is a front view of the clothespin with lower portions pressed to open upper toothed portions in the present invention.

A clothespin in the present invention, as shown in FIGS. 2 and 3, is made as one unit by means of plastic injecting process, comprising two opposite pin plates 2, 3, two elastic plates 20, 30 respectively extending from bottom ends of the two plates, 2, 3 and bending inward or upward. The elastic plate 20 has a stopper 200 formed slightly bending at the end, two projections 201, 202 protruding upward and downward near the stopper 200. The pin plates 2, 3 respectively have two roughened surfaces 21, 31 on lower portions for fingers to push, teeth 22, 32 on the upper inner portions for pinching clothes. An elastic curved-up bridge 4 is formed between inner intermediate portions of the pin plates 2, 3 to give good elasticity to the two pin plates 2, 3 to be pressed so as to let the upper toothed portions of pin plates 2, 3 be opened.

Figure 4:
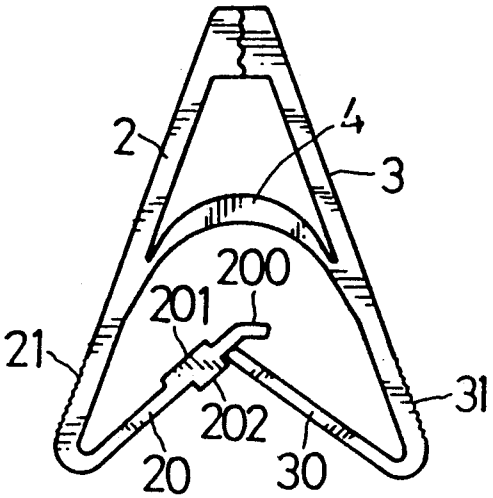
FIG. 4 is a front view of the clothespin conditioned to be used in the present invention.

In using, at first the elastic plate 20 is to be pressed inward or upward, forcing the upper end of the projection 202 of the elastic plate 20 pushingly supported at its place by the top of the other elastic plate 30 as shown in FIG. 4. Though the elastic plates 20, 30 have elasticity to recover their original positions, the elastic plate 30 is prevented from going down to the original position blocked by the projection 202 of the elastic plate 20. When this clothespin is to be used to pinch clothes, the roughened surfaces 21, 31 of the pin plates 2, 3 are gripped and pressed inward with fingers, forcing the upper toothed portions of the pin plates 2, 3 to open outward with the elastic bridge 4 compressed and the elastic plates 20, 30 also compressed to bend inward and by means of the stopper 200 blocking the top of the elastic plate 30. After a clothes is placed between the upper toothes portions of the pin plates 2, 3, the fingers are released to let the elastic bridge 4 recover its elasticity, permitting the upper toothed portions closed up to pinch the clothes between the two teeth 22, 32. And the elastic plates 20, 30 also move down elastically helping the bridge 4 to force the upper toothed portions to close up so that the toothed portions can pinch with much force.

What is claimed is:

1. A clothespin made of plastic as one unit, comprising;

two opposite pin plates having teeth on upper inner portions for pinching clothes, an elastic plate extending bendingly inward from a bottom end of each pin plate, a slightly bending stopper formed at the end of one of the elastic plates, a projection on and under the same elastic plates near the end stopper;

an elastic curved-up bridge formed between intermediate portions of said two pin plates to supply elasticity to recover said pin plates its original closed position after lower portions of said pin plates are pressed inward to force open the upper toothed portions for pinching clothes; and said elastic plate with the stopper and the two projections being pressed upward or inward to let the top of the other elastic plate push and support the upper end of the lower projection of said elastic plate at its place so that said two elastic plates may also have elasticity to recover their position after pressed inward by the lower portions of the pin plates, in addition to that of said elastic bridge, so as to always keep the upper toothed portions of said pin plates tensely closed up for pinching clothes between them.

* * * * *